United States Patent [19]

Tomcavage

[11] 3,976,909

[45] Aug. 24, 1976

[54] WIRE MESH CATHODE

[75] Inventor: Joseph Richard Tomcavage, Lancaster, Pa.

[73] Assignee: RCA Corporation, New York, N.Y.

[22] Filed: July 11, 1975

[21] Appl. No.: 595,287

[52] U.S. Cl. ..... 313/341; 313/343; 313/346 R; 313/348

[51] Int. Cl.[2] ..... H01J 1/15; H01J 19/08

[58] Field of Search ..... 313/341, 343, 346, 348

[56] References Cited

UNITED STATES PATENTS

| | | | |
|---|---|---|---|
| 2,882,436 | 4/1959 | Dorgelo | 313/343 X |
| 3,449,616 | 6/1969 | Sarrois | 313/337 X |
| 3,473,073 | 10/1969 | Gerlach | 313/270 X |
| 3,806,754 | 4/1974 | Hinkel | 313/348 |
| 3,824,424 | 7/1974 | McNees et al. | 313/341 |

*Primary Examiner*—Saxfield Chatmon, Jr.
*Attorney, Agent, or Firm*—Glenn H. Bruestle; George E. Haas

[57] ABSTRACT

A first array of spaced wires is in angular contact with a second array of spaced wires so as to from a wire mesh. The first array has a fewer number of wires than the second array.

10 Claims, 2 Drawing Figures

WIRE MESH CATHODE

BACKGROUND OF THE INVENTION

The present invention relates to wire mesh cathodes for electron tubes. In high power, high frequency electron tubes, the cathode occasionally takes on the configuration of a wire mesh or screen. The mesh may consist of an array of wires extending across and welded to another array of wires. Heretofore both arrays contained an equal number of wires. In a closely spaced tube, one of the arrays in the cathode is appreciably closer to the control grid than the other array of wires. The more remote array may be 50% farther from the control grid than the closer array in some tubes. In this case, due to the difference in distance of the arrays from the control grid, 90% of the emission current in the electron tube is emitted from the array closest to the grid.

One of the major design considerations in high powered tubes is heat dissipation. It is therefore advantageous to design a tube which consumes as little filament heater power as possible. In the example noted above, although the remote array carries only 10% of the emission current, in a hot cathode, it absorbs 50% of the filament heater power, thereby consuming an unjustifiable amount of heater power.

SUMMARY OF THE INVENTION

A wire mesh cathode is formed by a first array of spaced wires in angular contact with a second array of spaced wires. The first array has a fewer number of wires than the second array.

DETAILED DESCRIPTION OF THE INVENTION

Figure 1:
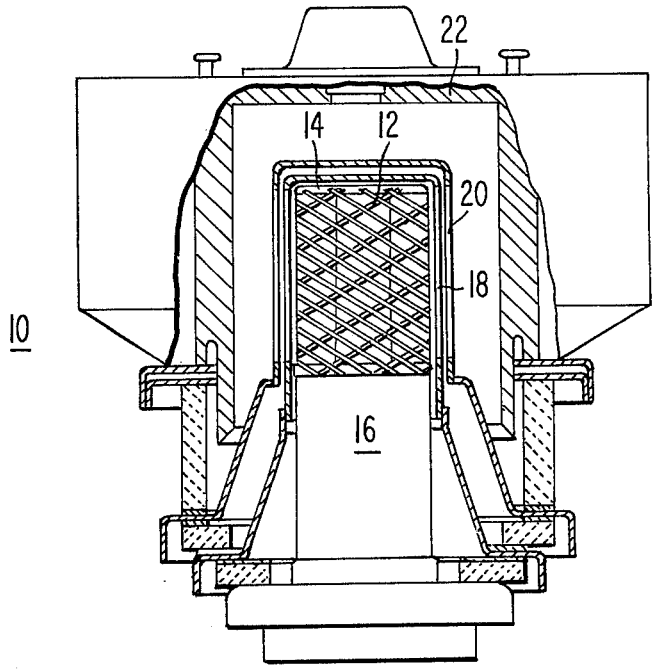
FIG. 1 is a cut-away view of an electron discharge tube employing the novel cathode of the present invention.

With initial reference to FIG. 1, an electron tube 10 comprises a cylindrical wire mesh cathode 12 that extends between and is fixed to two cylindrical terminals 14 and 16, so as to form a directly heated cathode. Closely spaced around the cathode 12 is an apertured control grid 18 and an apertured screen grid 20 surrounding the control grid. Surrounding the screen grid 20 is an anode 22. Specific details concerning the construction of tube 10 may be found in U.S. Pat. No. 2,951,172 issued on Aug. 30, 1960 to W. C. Griffiths Jr. et al.

Figure 2:
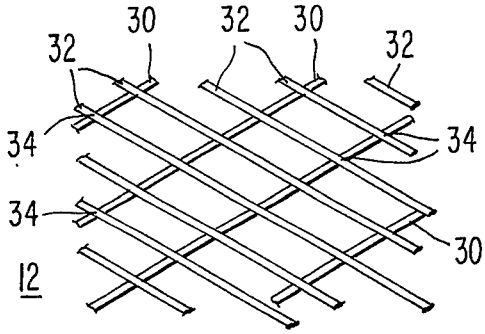
FIG. 2 is an enlarged view of a section of the cathode.

It should be noted that the cathode 12 is in the shape of an elongated cylinder. However, the cathode 12 in the present invention may take on other geometries. Referring to FIGS. 1 and 2, the cathode 12 is formed of a first array 30 of spiral wires extending between the two cylindrical terminals 14 and 16. The spirals of wire in the first array 30 have a constant pitch and constant angle from one end of the cathode to the other. A second array 32 of wires extends in the opposite direction between the cylindrical filament terminals and also has a constant pitch and a constant angle. It is preferred that the wires in each array are equidistantly spaced from each other. The second array 32 of wires is around the outer diameter of the first array 30 and is electrically connected, by welding for example, to the first array at the crossover points 34. The second array 32 which is closer to the control grid 18, has a greater number of wires than the first array 30. The wires may be made of thoriated tungsten.

By decreasing the number of wires in the first array 30, the mass of the cathode 12 has been decreased and therefore the amount of power necessary to heat the cathode is decreased. Since most of the emission current is carried on the second array 32 which is closest to the control grid 18, the decrease in the number of wires in the first array 30 does not appreciably effect the emission current of the tube 10. In fact when the first array 30 has half the number of wires of the second array 32, the emission current of the tube is reduced only 5% when compared to a similar device having an equal number of wires in both arrays. In addition, when the first array has half as many wires as the second array, the filament heater power is reduced by 25%. The 25% reduction in the filament power results in a tube that requires less control and screen grid heat dissipation capability and results in more stable control and screen grid wire structure.

I claim:

1. A wire mesh cathode comprising a first cylindrical array of spaced spiralling wires; and a second cylindrical array of spaced spiralling wires in angular contact with the first array, the first array having a fewer number of wires than the second array, the wires in both arrays being made of thoriated tungsten.

2. The cathode as in claim 1 wherein the first array has 50% fewer wires than the second array.

3. The cathode as in claim 1 wherein the wires in each array are equidistantly spaced from one another.

4. The cathode as in claim 1 wherein the wire mesh cathode has a cylindrical shape with the second array of wires extending around the outer diameter of the first array.

5. The cathode as in claim 4 including two cylindrical terminals between which the cathode extends.

6. A vacumn tube comprising:

a wire mesh cathode having a first array of spaced wires and a second array of spaced wires in angular contact with the first array, the first array having a fewer number of wires than the second array, the wires in both arrays being made of thoriated tungsten; and an anode spaced from the cathode.

7. The tube as in claim 6 including at least one grid electrode between the cathode and the anode.

8. The tube as in claim 6 wherein the first array has 50% fewer wires than the second array.

9. The tube as in claim 6 wherein the wires in each array are equidistantly spaced from one another.

10. The tube as in claim 6 wherein the cathode has a cylindrical shape and is formed of two arrays of spiralling wires.

* * * * *